United States Patent [19]

Gurbin

[11] 4,148,457

[45] Apr. 10, 1979

[54] ICE CUBE TRAY

[76] Inventor: Florian Gurbin, 331 Gosfield Ave., Essex, Ontario, Canada

[21] Appl. No.: 812,129

[22] Filed: Jul. 1, 1977

[51] Int. Cl.[2] ..... B28B 7/06; F25C 1/24

[52] U.S. Cl. ..... 249/130; 249/127

[58] Field of Search ..... 249/119, 121, 127, 130, 249/133, 71, 117

[56] References Cited

U.S. PATENT DOCUMENTS

| | | | |
|---|---|---|---|
| 2,269,642 | 1/1942 | Zerk | 249/121 X |
| 2,497,743 | 2/1950 | Roethel | 249/127 |
| 2,587,852 | 3/1952 | Jahn et al. | 249/130 |
| 3,021,695 | 2/1962 | Voightmann | 249/127 |
| 3,120,112 | 2/1964 | Davis | 249/127 X |
| 3,214,128 | 10/1965 | Beck et al. | 249/127 X |
| 3,317,177 | 5/1967 | Brand | 249/119 |
| 3,930,376 | 1/1976 | Schwartz | 249/127 X |

*Primary Examiner*—Richard B. Lazarus
*Assistant Examiner*—John S. Brown
*Attorney, Agent, or Firm*—Barnes, Kisselle, Raisch & Choate

[57] ABSTRACT

An ice cube tray comprising a body of plastic or pressure die cast material or sheet metal having generally relatively thin uniform thickness throughout, and a top wall with at least the central portion thereof having a flat top surface. The flap top surface has a plurality of longitudinally spaced openings and a bottom wall and side walls extending downwardly from the edges of each opening to define a cavity. Each bottom wall is arcuate in a transverse direction. Depressions are provided in the top wall at the juncture of the bottom walls or side walls to form water level control surfaces to maintain the water level to form an ice cube whose top surface is at or below the center line forming the said arcurate wall.

2 Claims, 8 Drawing Figures

ICE CUBE TRAY

BACKGROUND OF THE INVENTION

Ice cube trays utilized for forming ice cubes conventionally comprise a body having one or more rows of cavities into which the water is introduced for freezing. In most ice cube trays that are conventionally used, the ice cubes are removed by inverting the tray and applying heat such as hot water to cause the ice cubes to fall out of the tray, by flexing the tray, or by actuating some mechanism to loosen the ice cubes.

It has heretofore been suggested that selective removal of ice cubes from a tray without affecting the remaining ice cubes might be achieved by having the cavities formed with arcuate bottom surfaces or walls so that by manipulation of a single ice cube a rotating motion is applied to the ice cubes permitting its removal without inverting the tray. Such ice cubes are found in the art as for example in U.S. Pat. Nos. 1,868,503, 1,889,481, 2,269,642, 2,769,742, and 3,120,112.

One of the problems with respect to such ice cube trays is that in filling or in the case where the ice cube tray is tilted before freezing, the water tends to overflow from one cavity to another and in some instances causes a frozen connection between adjacent cavities that is difficult to break loose in attempting to remove one or more ice cubes and cracking or shattering of the tray often results. The problem is even more critical where the tray is made of plastic and the water tends to flow more readily from one cavity to another or in wherein communication is provided between cavities intentionally to insure filling of the cavities such as in U.S. Pat. Nos. 1,868,503 or 3,120,112.

Accordingly among the objects of the invention are to provide a plastic ice cube tray wherein the ice cubes can be readily removed.

SUMMARY OF THE INVENTION

In accordance with the invention, the tray is made of injection molded plastic or pressure die cast metal or sheet metal and depressions are formed in the top wall at the juncture with the bottom wall or side walls of each cavity of the ice cube tray to form water level control surfaces to maintain the water level below the top surface, thereby preventing the water from overflowing and freezing on the top surface. The thickness of the tray material is such that the tray is sufficiently pliable to permit twisting of one end of the tray relative to the other to break the seal between the frozen ice cubes and the walls of the tray.

DESCRIPTION

Figure 1:
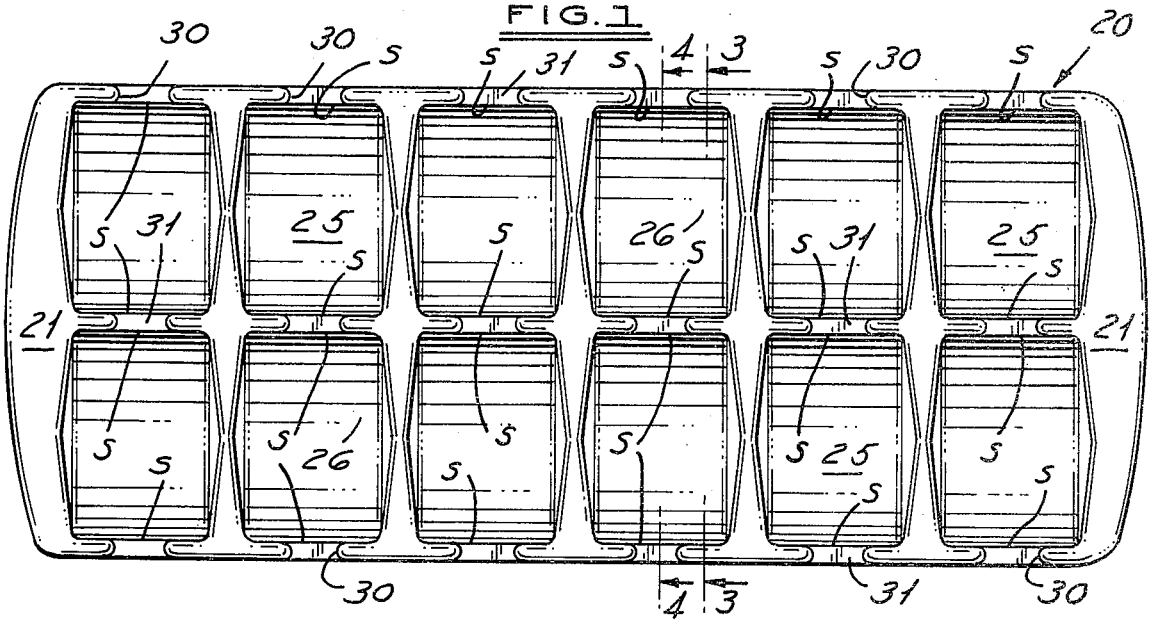
FIG. 1 is a plan view of an ice cube tray embodying the invention.

Referring to FIGS. 1–4, the ice cube tray 20 embodying the invention is made from a single body of plastic material such as polyethylene and is preferably made by injection molding, vacuum forming of plastic or pressure die cast metal or sheet metal in order to acheive the configurations and relatively thin uniform thickness as well as the specific construction of the invention. The thickness of the tray material is such that the tray is sufficiently pliable to permit twisting of one end of the tray relative to the other to break the seal between the frozen ice cubes and the walls of the tray. The ice cube tray 20 comprises a top wall 21 having a flat top surface and a peripheral flange 22.

The body is of generally uniform thickness throughout and further comprises a plurality of openings 25 herein shown as six sided and generally diamond shaped. A bottom wall 26 and side walls 27 are associated with each opening 25 to define a cavity. The openings 25 extend in two longitudinally spaced parallel rows along the length of the tray 20.

Each bottom wall 26 is cylindrical in shape and of generally uniform width and is connected to the side wall 27 by arcuate corner portions 28, the side walls 27 extending upwardly to the periphery of the openings 25.

In accordance with the invention depressions 30 are formed in the top surface 21 at the juncture of the upper edge of each bottom wall 26 with the top surface to form overflow passages having a base wall 31. At least some of the depressions 30 extend thru peripheral lip 22. The juncture of the bottom wall 26 and base wall 31 is preferably a sharp edge S sufficient to prevent water that flows out of each cavity from accumulating and freezing at the edge. Since the depressions prevent filling of the cavities above base walls 31, the water cannot overflow onto top surface 21 and freeze in a manner to prevent or defer removal of the ice cubes. The center of the radius curvature of each bottom wall is preferably at the bottom of depressions 30 or above.

It can be seen that each of the cavities formed by the bottom wall 26 and side walls 27 is spaced longitudinally from the other and the side walls 27 of one cavity are spaced from the side walls 27 of the adjacent cavity.

Figure 5:
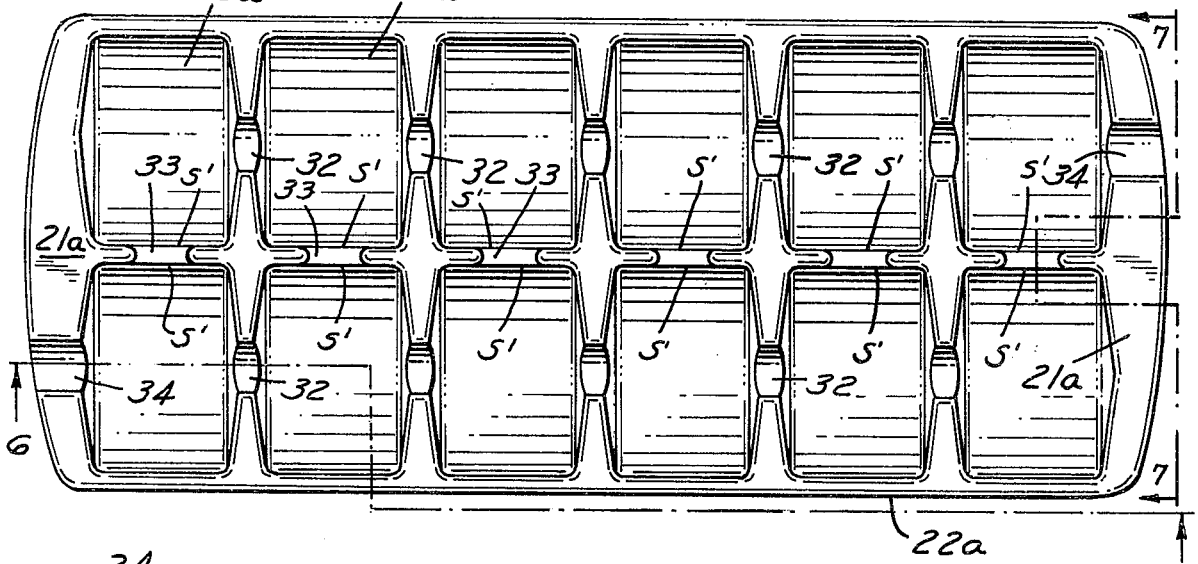
FIG. 5 is a fragmentary plan view of a modified form of ice cube tray.
Figure 6:
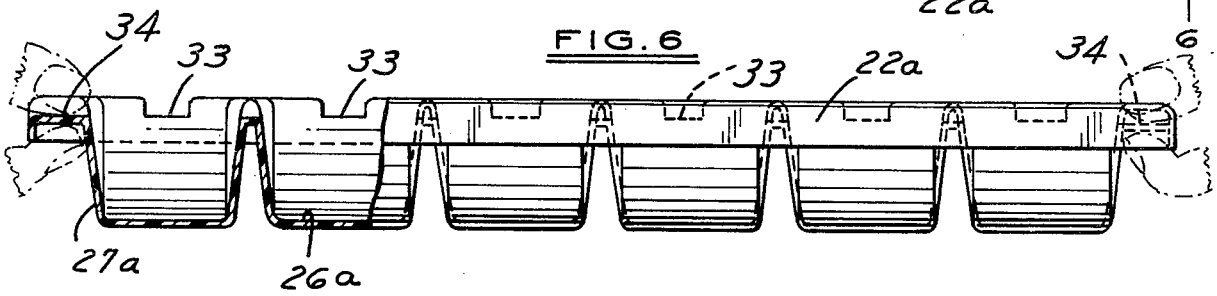
FIG. 6 is a fragmentary sectional view taken along the line 6—6 in FIG. 5.
Figure 7:
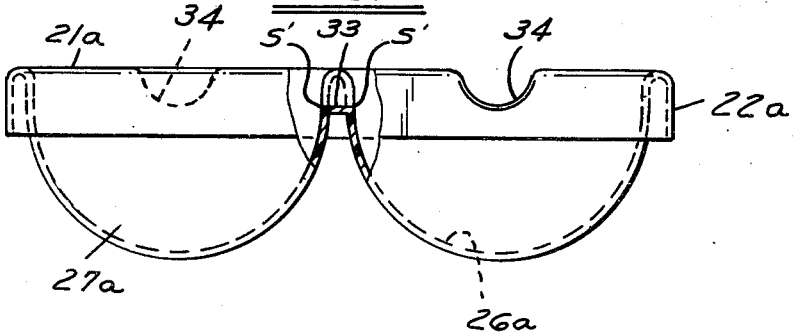
FIG. 7 is a part sectional view of the modified form of the ice cube tray taken along the line 7—7 in FIG. 5.

In the form of the invention shown in FIGS. 5–7, the depressions 32 are formed at the juncture of the top surface **21*a* and side walls 27*a* and depressions 33 are formed at the juncture of the inner upper edges of bottom walls 26*a* and the top surface. Sharp edges S' are provided only at the juncture of the depressions 33 and the bottom walls 26*a*** and have a sharpness sufficient to prevent water that flows out of each cavity from accumulating and freezing at the edge.

Depressions 34 are also provided at diagonally opposed portions of the ends of the top wall and lip **22*a*** to permit overflow. In practice, the thumbs of a user cover the depressions to permit carrying the tray filled with water, without spilling the water.

Figure 2:
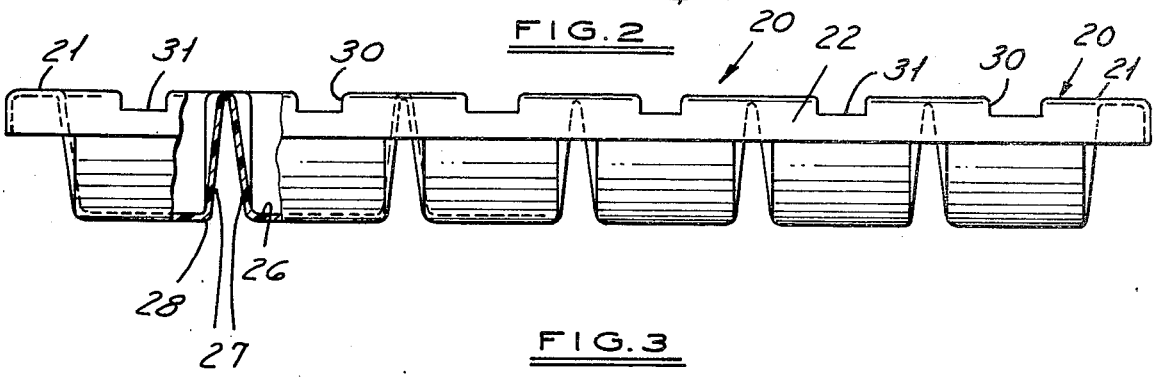
FIG. 2 is a part section side elevation view of the ice cube tray.
Figure 3:
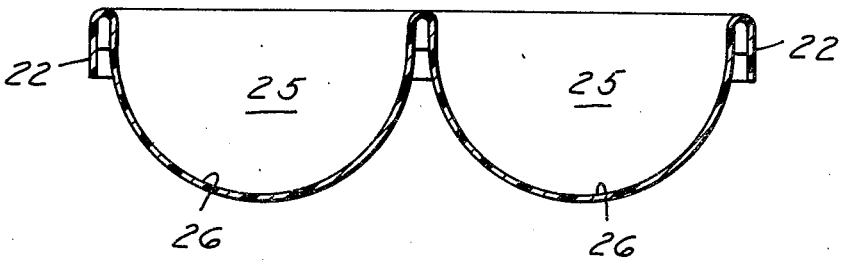
FIG. 3 is a fragmentary sectional view on an enlarged scale taken along the line 3—3 in FIG. 1.
Figure 4:
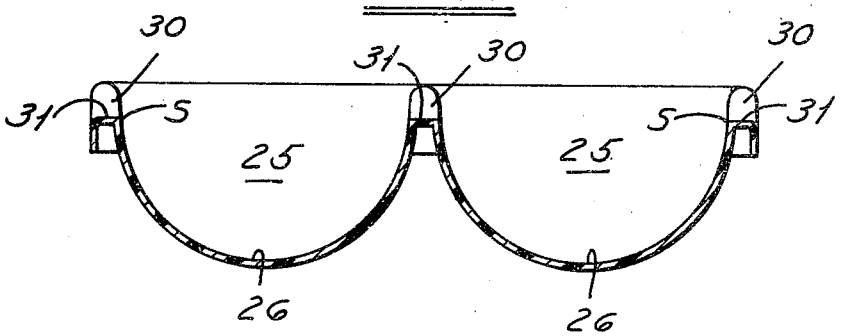
FIG. 4 is a fragmentary sectional view on an enlarged scale taken along the line 4—4 in FIG. 1.
Figure 8:
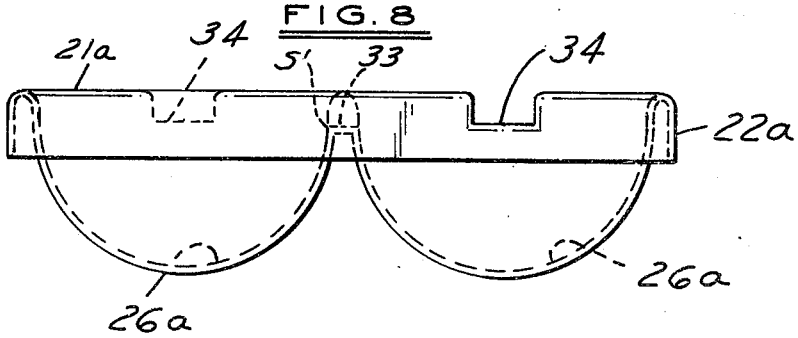
FIG. 8 is an end view of a further modified form of the ice cube tray.

In either form, the shape of depressions 30, 31, 32, 33, 34 may be rectangular as shown in FIGS. 2, 6 and 8 or arcuate as shown in FIG. 7.

In each of the forms of the invention, one of the important features of the invention comprises the arrangement wherein the depressions are formed at the juncture of the top surface and side walls or bottom wall. When force is applied to one end of each ice cube to remove it, it is readily disconnected from the ice cube tray; as contrasted to an arrangement wherein the ice formed along the top surface makes it difficult to remove the cube by applying a force to one end thereof. The provision of depressions 30, 32, 33, 34 facilitates making of the tray by vacuum forming of plastic or drawing sheet metal by allowing for flow of material into position to form the ice cube cavities.

I claim:

1. An ice cube tray comprising a body of material, said body being of relatively thin generally uniform thickness throughout, said body having a top wall with at least the central portion thereof having a flat top surface intended to be disposed generally horizontal when freezing water to form ice cubes in said tray, said portion with said flat top surface having two laterally spaced rows of longitudinally spaced upwardly facing openings in side by side relation, a bottom wall and side walls extending downwardly from the edges of said flat top surface around the margin of each said opening to define a cavity for holding water to be frozen into an ice cube therein, each said side wall being inclined downwardly and inwardly toward said bottom wall, each said bottom wall being arcuate in one direction and generally rectangular in outline as viewed in plan projection looking downwardly into the associated opening perpendicularly to said flat top surface, the upper edges of said bottom walls and side walls being connected to said top wall at said flat top surface, each opening being separated from the adjacent opening in the same row and the adjacent opening in the other row by a separating portion of said flat surface of said top wall, and a depression in each of said separating portions of said top wall at the area of juncture of said top wall and each said cavity, each said depression defining an overflow passage through the associated separating portion and between associated adjacent openings with the bottom of each of said overflow passages having a maximum depth dimension measured from said flat top surface lesser than that of said bottom walls and the same as the bottom of each of the other overflow passages to thereby provide an overflow passage network in and amongst said cavities establishing a uniform overflow elevation spaced below the elevation of said flat top surface in the horizontal disposition thereof, each bottom wall having an arcuate curvature of uniform radius with the center of curvature of each bottom wall being at or above the bottom of said depressions such that an ice cube frozen in an associated cavity is removable therefrom by pushing downwardly the upper surface of said cube at said overflow level at either of the ends of said cube contacting the associated bottom wall to thereby depress said pushed end while imparting bodily rotation to such ice cube about the center of curvature of the bottom wall of the associated cavity, thus upending the opposite end of such ice cube to make the same finger grippable as the cube slides along said bottom wall during such bodily rotation thereof, each said depression between the cavity of one row and the adjacent cavity of an adjacent row comprising a base wall joined to the upper edge of the associated bottom wall along a sharp edge sufficiently thin to prevent water that flows out of each cavity from accumulating or freezing at the edge so as to prevent or impede removal of the ice cubes when depressing said one end of said cubes to impart the aforesaid bodily rotation thereto, at least two additional depressions in said top wall, one extending from an endmost cavity in one row at one end of the tray and one extending from the endmost cavity in the other row at the opposite end of the tray, and through the periphery of said tray to provide at least two overflow passage outlets from said tray and to serve as finger receiving recesses for transporting a tray filled with water without spilling the water therein, the bottom of said outlets being at an elevation no higher than said uniform overflow elevation in the horizontal disposition of said flat top surface.

2. An ice cube tray comprising a body of material, said body being of relatively thin generally uniform thickness throughout, said body having a top wall with at least the central portion thereof having a flat top surface intended to be disposed generally horizontal when freezing water to form ice cubes in said tray, said portion with said flat top surface having two laterally spaced rows of longitudinally spaced upwardly facing openings in side by side relation, a bottom wall and side walls extending downwardly from the edges of said flat top surface around the margin of each said opening to define a cavity for holding water to be frozen into an ice cube therein, each said side wall being inclined downwardly and inwardly toward said bottom wall, the upper edges of said bottom walls and side walls being connected to said top wall at said flat top surface, each opening being separated from the adjacent opening in the same row and the adjacent opening in the other row by a separating portion of said flat surface of said top wall, and an overflow surface at each of said separating portions of said top wall at the area of juncture of said top wall and each said cavity, each said overflow surface defining an overflow for water across the associated separating portion and between associated adjacent openings with the bottom of each of said overflow surface having a maximum depth dimension measured from said top wall lesser than that of said bottom walls and the same as the bottom of each of the other overflow surfaces to thereby provide an overflow network amongst said cavities establishing a uniform overflow elevation spaced below the uppermost elevation of said top wall in the horizontal disposition thereof, each said bottom wall being arcuate in one direction and having an arcuate curvature of uniform radius with the center of curvature of each bottom wall being at or above the bottom of said overflow surfaces such that an ice cube frozen in an associated cavity is removable therefrom by pushing downwardly the upper surface of said cube at said overflow level at either of the ends of said cube contacting the associated bottom wall to thereby depress said pushed end while imparting bodily rotation to such ice cube about the center of curvature of the bottom wall of the associated cavity, thus upending the opposite end of such ice cube to make the same finger grippable as the cube slides along said bottom wall during such bodily rotation thereof, each said overflow surface between the cavity of one row and the adjacent cavity of an adjacent row comprising a base wall joined to the upper edge of the associated bottom wall along a sharp edge sufficiently thin to prevent water that flows out of each cavity from accumulating or freezing at the edge so as to prevent or impede removal of the ice cubes when depressing said one end of said cubes to impart the aforesaid bodily rotation thereto, at least two end overflow depressions in said top wall, one of said overflow depressions extending from an endmost cavity at one end of the tray and the other one of said end overflow depressions extending from an endmost cavity in the opposite end of the tray, said end overflow depressions extending through the periphery of said tray at the opposite longitudinal ends of said tray to provide at least two overflow passage outlets from said tray and to serve as finger receiving recesses for transporting a tray filled with water without spilling the water therein, the bottom of said outlets being at an elevation no higher than said uniform overflow elevation in the horizontal disposition of said flat top surface.

* * * * *